US009235182B2

(12) United States Patent
Fukushi

(10) Patent No.: US 9,235,182 B2
(45) Date of Patent: Jan. 12, 2016

(54) FIXING DEVICE CAPABLE OF DETECTING WRAP JAM OF RECORDING SHEET AND IMAGE FORMING APPARATUS

(75) Inventor: Kenji Fukushi, Kashiwa (JP)

(73) Assignee: CANON KABUSHIKI KAISHA (JP)

( * ) Notice: Subject to any disclaimer, the term of this patent is extended or adjusted under 35 U.S.C. 154(b) by 480 days.

(21) Appl. No.: 13/098,720

(22) Filed: May 2, 2011

(65) Prior Publication Data

US 2011/0274446 A1 Nov. 10, 2011

(30) Foreign Application Priority Data

May 6, 2010 (JP) ..... 2010-106405

(51) Int. Cl.
*G03G 15/20* (2006.01)
*G03G 15/00* (2006.01)

(52) U.S. Cl.
CPC ..... *G03G 15/70* (2013.01); *G03G 15/2039* (2013.01); *G03G 15/205* (2013.01); *G03G 15/2078* (2013.01)

(58) Field of Classification Search
CPC ..... G03G 15/2071
USPC ..... 399/22, 33, 67, 69, 122; 219/200, 209, 219/243, 244, 650, 667
See application file for complete search history.

(56) References Cited

U.S. PATENT DOCUMENTS 6,501,914 B2 * 12/2002 Yoshikawa ..... 399/18
2004/0086295 A1 * 5/2004 Peng et al. ..... 399/69
2005/0201768 A1 * 9/2005 Tatematsu et al. ..... 399/69
2007/0242959 A1 * 10/2007 Aono et al. ..... 399/13
2008/0260406 A1 * 10/2008 Sone et al. ..... 399/69
2008/0305424 A1 * 12/2008 Yamaguchi ..... 430/124.1
2009/0028590 A1 * 1/2009 Nanataki et al. ..... 399/44
2010/0054785 A1 * 3/2010 Ogiso et al. ..... 399/69
2011/0020018 A1 * 1/2011 Takenaka et al. ..... 399/33
2011/0026947 A1 * 2/2011 Hayamizu ..... 399/33
2011/0064440 A1 * 3/2011 Saitoh ..... 399/69
2011/0142472 A1 * 6/2011 Mitsuoka et al. ..... 399/69
2011/0206388 A1 * 8/2011 Sasaoka ..... 399/21

FOREIGN PATENT DOCUMENTS

JP 2004-354983 A 12/2004
JP 2006-251488 A 9/2006

* cited by examiner

*Primary Examiner* — Judy Nguyen
*Assistant Examiner* — Quang X Nguyen
(74) *Attorney, Agent, or Firm* — Rossi, Kimms & McDowell LLP

(57) ABSTRACT

A fixing device capable of easily detecting a wrap jam of a recording sheet without increasing costs. A fixing roller fixes a toner image on a recording medium under heating control. A central thermistor and an end thermistor detect first and second temperatures of the fixing roller in respective sheet-passing and non-sheet-passing areas. A first temperature difference-detecting circuit compares a temperature difference between the first and second detected temperatures and a first threshold and outputs a first comparison result. A second temperature difference-detecting circuit compares the temperature difference and a second threshold larger than the first threshold and outputs a second comparison result. A switching circuit selects one of the first or second comparison results according to a switching signal from a CPU, and the CPU controls heating of the fixing roller based on the selected comparison result.

14 Claims, 9 Drawing Sheets

FIXING DEVICE CAPABLE OF DETECTING WRAP JAM OF RECORDING SHEET AND IMAGE FORMING APPARATUS

BACKGROUND OF THE INVENTION

1. Field of the Invention

The present invention relates to a fixing device that is used for fixing an unfixed toner image transferred onto a recording medium to form an image thereon, and an image forming apparatus that uses the fixing device.

2. Description of the Related Art

In general, an image forming apparatus using an electrophotographic process is equipped with a fixing device that heats and fixes an unfixed toner image transferred onto a recording medium (hereinafter also referred to as the "recording sheet"), and there are various types of heat sources used for the fixing device. In recent years, there is a demand for reduction of a warm-up time at the start of an image forming apparatus, and in view of this, there is a tendency to use a heater or the like which performs heating by so-called electromagnetic induction as a heat source.

A fixing device is generally provided with a fixing roller and a pressing roller, and a recording sheet is conveyed into a nip between the fixing roller and the pressing roller, where an unfixed toner image on the recording sheet is heated and fixed onto the recording sheet.

The above-mentioned fixing roller can be heated, and on-off control of the heater is performed based on a temperature detection signal obtained from a temperature sensor, such as a thermistor disposed on a surface of the fixing roller. Then, by the on-off control of the heater, the surface temperature of the fixing roller is controlled such that it becomes a predetermined temperature.

By the way, a recording sheet inevitably curls depending on the amount of toner attached thereto and the water content thereof. Then, due to the amount of curl, which is a degree of curling of a recording sheet, a recording sheet is sometimes wrapped around the fixing roller when fixing an image.

If a printing operation is performed in a state of the fixing roller in which a recording sheet is wrapped therearound, image defectivenesses, such as image roughness and faulty image fixing, may be caused on the image on the recording sheet when the printing operation has been executed, since the surface of the fixing roller is covered with the recording sheet.

Further, in a heater using electromagnetic induction heating, if a Curie material is used for the fixing roller, the surface temperature of the fixing roller is detected on the recording sheet wrapped around the fixing roller. That is, the surface temperature of the fixing roller is detected via the recording sheet, and as a result, the actual surface temperature of the fixing roller becomes higher than the temperature detected by the temperature sensor. Further, the surface temperature of the fixing roller sometimes becomes higher than the Curie temperature.

At this time, the impedance of an electromagnetic induction heating coil is rapidly reduced, and hence overcurrent flows into the electromagnetic induction coil, which sometimes causes failures, such as blowout of an AC fuse of the power source.

As mentioned above, when a failure occurs in the power source, it takes much time to recover the power source, which increases downtime in which the image forming apparatus is not available. To prevent such an inconvenience, it is necessary to immediately detect that a recording sheet is wrapped around the fixing roller. In short, it is required to reduce time to detect a wrap jam of a recording sheet.

To this end, there has been proposed a fixing device that detects a wrap jam of a recording sheet by disposing recording sheet-detecting sensors for detecting a recording sheet, on an inlet side and an exit side of the fixing device, respectively (see e.g. Japanese Laid-Open Patent Publication No. 2004-354983).

In Japanese Laid-Open Patent Publication No. 2004-354983, it is determined whether or not a recording sheet is wrapped around the fixing roller based on results of detection by the recording sheet-detecting sensors, and depending on a result of the determination, the driving and heating of the fixing roller are stopped.

Further, there has been also proposed a fixing device of a belt type in which a noncontact temperature sensor is disposed in an area where a sheet passes and a contact temperature sensor is disposed in an area where no sheet passes (see e.g. Japanese Laid-Open Patent Publication No. 2006-251488).

In Japanese Laid-Open Patent Publication No. 2006-251488, when the temperature detected by the contact temperature sensor becomes equal to a predetermined temperature, whether or not a recording sheet exists between the noncontact temperature sensor and a fixing belt is judged depending on whether or not the temperature detected by the noncontact temperature sensor has reached a predetermined temperature.

By the way, in the image forming apparatus described in Japanese Laid-Open Patent Publication No. 2004-354983, when a paper jam is caused, the user takes the fixing device out of the body of the image forming apparatus to perform jam removal. In this jam removal, the user manually rotates a fixing roller, which sometimes causes a recording sheet to be wrapped around the fixing roller.

If the power of the image forming apparatus is restored in this state, the recording sheet cannot be detected by the recording sheet-detecting sensor disposed on the inlet side of the fixing device, so that the fixing roller is heated.

To prevent such a situation, it is necessary to restrict manual rotation of the fixing roller by a user in jam removal by adding e.g. a mechanism for restricting the direction of rotating the fixing roller to thereby prevent a recording sheet from being wrapped around the fixing roller. However, there is a problem that addition of such a mechanism inevitably causes costs to be increased.

On the other hand, in the image forming apparatus described in Japanese Laid-Open Patent Publication No. 2006-251488, when the temperature detected in the area outside the sheet-passing area has reached a predetermined temperature, it is judged whether or not the temperature detected in the sheet-passing area is correct. Thus, the judgment on whether or not the temperature detected in the sheet-passing area is correct is performed according to the temperature detected in the area outside the sheet-passing area, which depends largely on the environment temperature, and hence it is difficult to uniquely determine a set value (i.e. predetermined value) for the temperature detected in the sheet passing area depending on the environment where the image forming apparatus is installed, or the last printing operation.

Further, if the contact temperature sensor disposed in the area outside the sheet-passing area is not normally brought into abutment with the fixing belt, it is becomes impossible to detect an increase in the temperature of an end portion of the fixing belt during the printing operation, and hence even when the difference between the actual temperature in the area outside the sheet-passing area and the temperature in the central area of the fixing belt is large, it is sometimes judged that the state of the fixing device is normal.

Therefore, in the image forming apparatus described in Japanese Laid-Open Patent Publication No. 2006-251488, there can be an increase in the difference between temperatures in the central area and the end portion of the fixing belt, causing an inconvenience, such as generation of wrinkles on a recording sheet.

SUMMARY OF THE INVENTION

The present invention provides a fixing device that is capable of easily detecting a wrap jam of a recording sheet without increasing costs, and an image forming apparatus using this fixing device.

In a first aspect of the present invention, there is provided a fixing device comprising a fixing unit configured to be subject to heating control to thereby fix a toner image on a recording medium, a first temperature-detecting unit configured to detect a temperature of the fixing unit in an area in which the recording medium passes to thereby obtain a first detected temperature, a second temperature-detecting unit configured to detect a temperature of the fixing unit in an area in which the recording medium does not pass to thereby obtain a second detected temperature, a first temperature difference-comparing unit configured to compare a temperature difference between the first and second detected temperatures and a first threshold to thereby obtain a first comparison result, a second temperature difference-comparing unit configured to compare the temperature difference and a second threshold larger than the first threshold to obtain a second comparison result, a selection unit configured to select one of the first comparison result and the second comparison result according to the second detected temperature, and a heating control unit configured to control heating of the fixing unit based on the comparison result selected by the selection unit.

In a second aspect of the present invention, there is provided an image forming apparatus comprising a transfer unit configured to transfer a toner image onto a recording medium according to image data, a fixing unit configured to be subject to heating control to thereby fix the toner image transferred by the transfer unit on the recording sheet, a first temperature-detecting unit configured to detect a temperature of the fixing unit in an area in which the recording medium passes to thereby obtain a first detected temperature, a second temperature-detecting unit configured to detect a temperature of the fixing unit in an area in which the recording medium does not pass to thereby obtain a second detected temperature, a first temperature difference-comparing unit configured to compare a temperature difference between the first and second detected temperatures and a first threshold to thereby obtain a first comparison result, a second temperature difference-comparing unit configured to compare the temperature difference and a second threshold larger than the first threshold to obtain a second comparison result, a selection unit configured to select one of the first comparison result and the second comparison result according to the second detected temperature, and a heating control unit configured to control heating of the fixing unit based on the comparison result selected by the selection unit.

According to the present invention, it is possible to easily detect a wrap jam of a recording sheet without increasing costs.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

Figure 1:
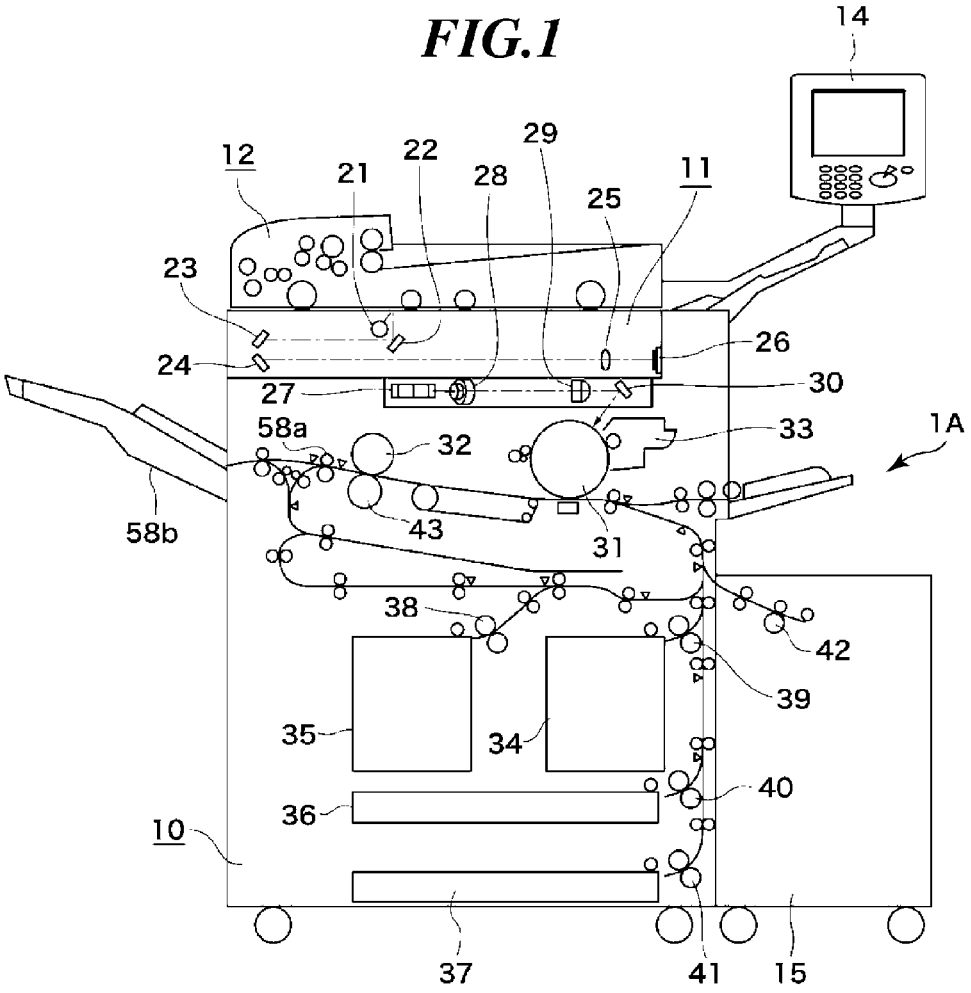
FIG. 1 is a schematic cross-sectional view of an image forming apparatus using an example of a fixing device according to an embodiment of the present invention.

FIG. 1 is a view of an image forming apparatus using a fixing device according to an embodiment of the present invention.

Referring to FIG. 1, an image forming apparatus 1A illustrated therein includes a main-unit image output section 10, a main-unit image input section 11, and an automatic document feeder 12. The main-unit image output section 10 outputs an image of an original (original image) on a recording sheet (recording medium). Further, the main-unit image input section 11 reads an original image as image data. Then, the automatic document feeder 12 is located on top of the main-unit image input section 11.

It should be noted that as illustrated in FIG. 1, the image forming apparatus 1A is provided with a display section (also referred to as the console section) 14, and by using the display section 14, a user can configure various settings, such as the settings for a copy mode. Further, various setting values and the current job status in the image forming apparatus are displayed on the display section 14.

The main-unit image output section 10 has sheet feeding cassettes 34, 35, 36, and 37 disposed therein, each of which accommodates recording sheets. It should be noted that in the illustrated example, the sheet feeding cassettes 34, 35, 36, and 37 accommodate different sizes of recording sheets, respectively.

Further, in the illustrated example, a paper deck 15 having a large capacity is connected to the main-unit image output section 10. These recording sheets are conveyed to an image forming section by sheet-conveying rollers 38, 39, 40, 41, and 42, which are selectively driven by a motor (not shown).

For example, in the copy mode, originals (or an original bundle) set on the automatic document feeder 12 are conveyed to an original platen glass (not shown) sheet by sheet. The main-unit image input section 11 includes a light source 21, and light emitted from the light source 21 scans each original set on the original platen glass in a transverse direction with respect to a sheet conveying direction.

This light is reflected by the surface of the original, and the optical image is formed by an image pickup element (e.g. CCD) 26 via mirrors 22, 23, and 24, and a lens 25. The CCD 26 converts the formed optical image to an electric signal (analog image signal), and the converted analog image signal is further converted to a digital image signal (referred to as the image data) by an A/D converter. Then, the converted image data is stored in an image memory (not shown) after performing image conversion, such as expansion and compression, according to a user's request.

In outputting image data, the main-unit image output section 10 reads out image data stored in the image memory, and converts the read image data back to an analog image signal. Then, the main-unit image output section 10 outputs a laser beam (also referred to as the optical signal) corresponding to the analog image signal by an optical irradiation section 27. This laser beam is irradiated onto a photosensitive drum 31 via a scanner 28, a lens 29, and a mirror 30. That is, the photosensitive drum 31 is scanned by the laser beam corresponding to the image data.

Figure 2:
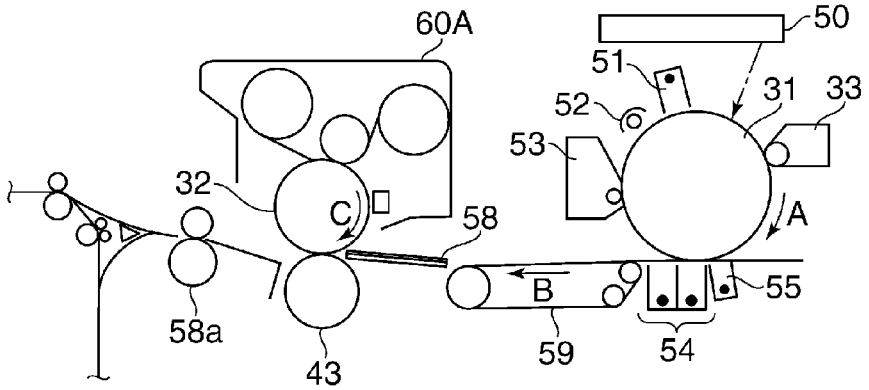
FIG. 2 is an enlarged schematic cross-sectional view of essential parts from a photosensitive drum to the fixing device of the image forming apparatus shown in FIG. 1.

FIG. 2 is an enlarged view of the image forming apparatus shown in FIG. 1, illustrating the arrangement of the photosensitive drum 31 to the fixing device 60A thereof in an enlarged manner.

Referring to FIGS. 1 and 2, the photosensitive drum 31 has a photoconductive layer of an organic photo conductor formed in a surface thereof, and is driven for rotation in a direction indicated by an arrow A in FIG. 2 at a predetermined speed during a copy job.

First, charges remaining on the photosensitive drum 31 are eliminated by a pre-exposure device (also referred to as the static eliminator) 52. Then, a primary electrostatic charger 51 uniformly charges the surface of the photosensitive drum 31. The above-mentioned laser beam is irradiated from a laser scanner unit 50 onto the photosensitive drum 31 to form an electrostatic latent image corresponding to the image data, on the photosensitive drum 31.

The laser scanner unit 50 appearing in FIG. 2 includes e.g. the optical irradiation section 27, the scanner 28, the lens 29, and the mirror 30 appearing in FIG. 1.

Then, the electrostatic latent image on the photosensitive drum 31 is developed by a developing device 33 into a toner image (also referred to as the visible image). As mentioned above, a recording sheet 58 is conveyed from the sheet feeding cassettes 34, 35, 36, or 37 along a sheet conveying path, and passes under the photosensitive drum 31 in synchronism with formation of the visible image.

At this time, a transfer charger 55 charges the recording sheet 58, whereby the visible image (toner image) on the photosensitive drum 31 is transferred onto the recording sheet 58. Thereafter, to facilitate separation of the recording sheet 58 from the photosensitive drum 31, the recording sheet 58 is charged by a separation charger 54.

The recording sheet 58 separated from the photosensitive drum 31 is conveyed in a direction indicated by an arrow B in FIG. 2 by a conveying belt 59, and reaches the fixing device 60A. The fixing device 60A includes a fixing roller (fixing unit) 32 and a pressure roller 43, and the fixing roller 32 is driven for rotation e.g. in a direction indicated by an arrow C in FIG. 2. The recording sheet 58 is introduced into a nip between the fixing roller 32 and the pressure roller 43.

As a result, the unfixed toner image on the recording sheet 58 is melted and fixed. Thus, the toner image is heated and fixed onto the recording sheet 58. Then, the recording sheet 58 is discharged onto a discharge tray 58*b* by a discharge roller 58*a* and so forth.

After the transfer operation, toner remaining on the photosensitive drum 31 is scraped off by a drum cleaner 53. Then, charges remaining on the photosensitive drum 31 are eliminated by the pre-exposure device 52, and the photosensitive drum 31 prepares for the next copy operation.

Figure 3:
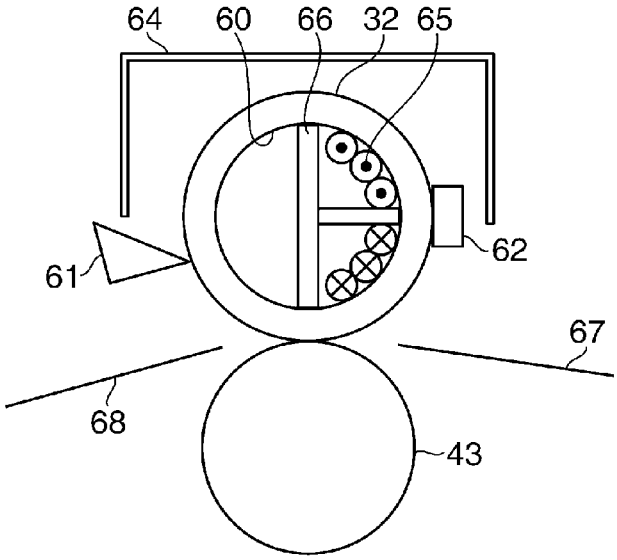
FIG. 3 is an enlarged schematic cross-sectional view of the fixing device appearing in FIG. 2.

FIG. 3 is an enlarged view of the fixing device 60A appearing in FIG. 2. Referring to FIG. 3, the fixing roller 32 has an induction heating coil holder 60 disposed therein. In the induction heating coil holder 60, there are arranged an induction heating coil (simply referred to as the coil) 65 and a ferrite core 66. To the coil 65 is applied a high-frequency current from an electromagnetic induction heating power source (not shown in FIG. 3), and the fixing roller 32 is heated by electromagnetic induction heating by the coil 65.

The surface temperature of the fixing roller 32 is detected by a central thermistor (also referred to as the temperature sensor: first temperature-detecting unit) 62 of a contact type. The central thermistor 62 is disposed on a central portion of the fixing roller 32 in a direction from a front side to a reverse side of the drawing sheet as viewed in FIG. 3 (longitudinal direction). Further, the central thermistor 62 is disposed in a position avoiding the nip between the fixing roller 32 and the pressure roller 43.

The temperature detected by the central thermistor 62 is provided to a controller, such as a CPU 70 (not shown in FIG. 3), and the controller (CPU 70) controls the temperature of the fixing roller 32 to a predetermined temperature based on the detected temperature, as described hereinafter.

The periphery of the fixing roller 32 is covered with a heat-insulating member 64 to prevent heat generated at the fixing roller 32 from transferring outside. The fixing roller 32 is driven for rotation by a drive source, such as a motor (not shown). The rotation of the fixing roller 32 causes the recording sheet 58 (FIG. 2) conveyed on a fixing inlet conveying path 67 to pass through the nip between the fixing roller 32 and the pressure roller 43 to be conveyed onto a fixing exit conveying path 68.

A separation claw 61 is disposed on the upper side of the fixing exit conveying path 68, and the recording sheet 58 is separated from the fixing roller 32 by the separation claw 61. Incidentally, if the separation claw 61 is brought into close contact with the fixing roller 32, the surface of the fixing roller 32 is damaged, which causes an inconvenience, such as a fixing error. To prevent such an inconvenience, it is necessary to arrange the separation claw 61 in a manner spaced from the fixing roller 32 by about 1 mm.

Figure 4:
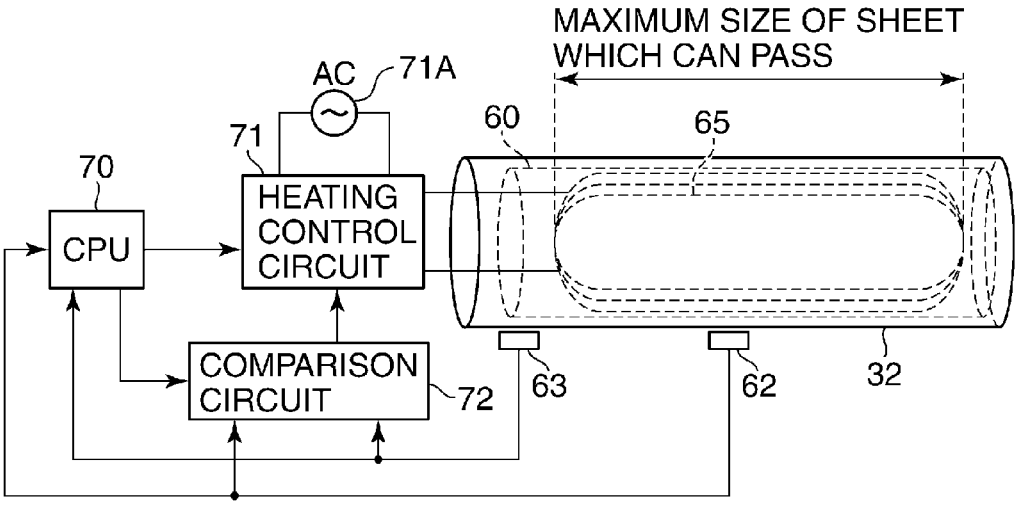
FIG. 4 is a block diagram of a control system used for the fixing device shown in FIG. 3.

FIG. 4 is a block diagram useful in explaining a control system used for controlling the fixing device 60A shown in FIG. 3.

Referring to FIG. 4, although not shown in FIG. 3, the fixing roller 32 has two thermistors (62 and 63) for detecting temperature, arranged along the longitudinal direction thereof. The above-mentioned central thermistor 62 (first temperature-detecting unit) is disposed at a substantially central portion of the fixing roller 32 in the longitudinal direction in association with a minimum sheet size which can pass. In short, the central thermistor 62 is disposed in a sheet-passing area.

On the other hand, the end thermistor 63 (second temperature-detecting unit) is located outside the lateral ends of the recording sheet which having a maximum sheet size and capable of passing between the fixing roller 32 and the pressure roller 43 as they are positioned when the recording sheet passes therebetween. That is, the end thermistor 63 is located outside the sheet-passing area (non-sheet-passing area).

As described above, since the end thermistor 63 is disposed in the non-sheet-passing area, it is preferable to arrange the coil 65 such that the coil does not reach the end thermistor 63 so as not to generate excess heat.

Surface temperatures of the fixing roller 32 detected by the central thermistor 62 and the end thermistor 63 as first and second detected temperatures, respectively, are delivered to the CPU 70 and a comparison circuit 72. The comparison circuit 72 determines a difference between the first and second detected temperatures as a temperature difference, and as described hereinafter, compares the determined temperature difference with predetermined thresholds to determine a plurality of comparison results. Then, a selected one the comparison results of the determination is delivered, as a comparison circuit output, to a heating control circuit 71.

The CPU 70 delivers a switching signal to the comparison circuit 72, and as will be described hereinafter, switches the output from the comparison circuit 72 (comparison circuit output). The heating control circuit 71 controls electric power (e.g. high-frequency current) to be applied to the coil 65 according to the comparison circuit output under the control of the CPU 70.

Figure 5:
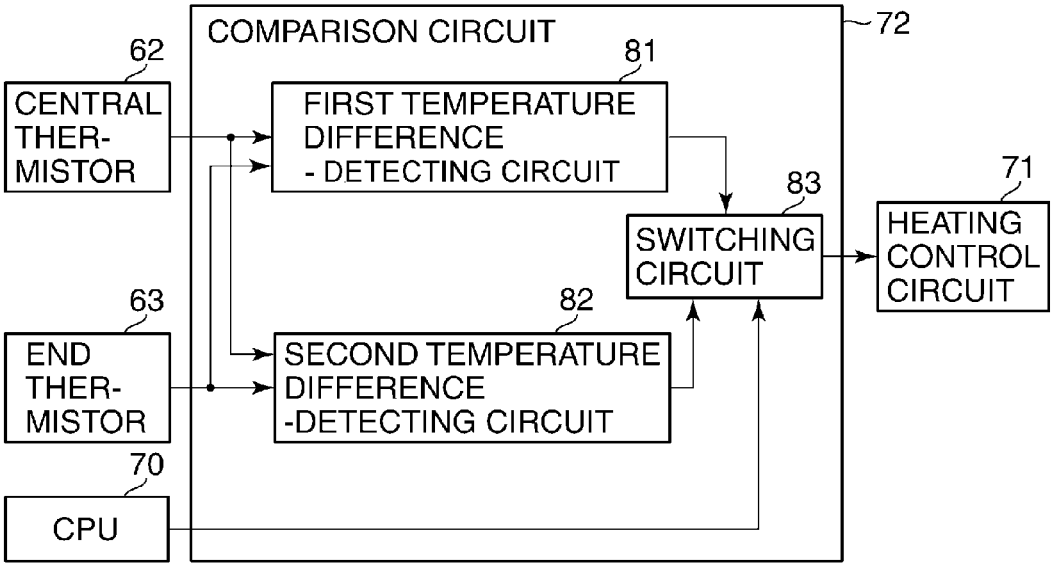
FIG. 5 is a block diagram of a comparison circuit appearing in FIG. 4 and component elements associated therewith.

FIG. 5 is a block diagram of the comparison circuit 72 appearing in FIG. 4. Referring to FIGS. 4 and 5, the comparison circuit 72 includes first and second temperature difference-detecting circuits 81 and 82, and a switching circuit 83. As shown in FIG. 5, the temperatures detected by the central thermistor 62 and the end thermistor 63, i.e. the first and second detected temperatures are delivered to the first and second temperature difference-detecting circuits 81 and 82, respectively. It should be noted that the first and second temperature difference-detecting circuits 81 and 82 correspond to first and second temperature difference-comparing units in the present invention, respectively.

The first and second temperature difference-detecting circuits 81 and 82 each determine a temperature difference indicative of the difference between the first and second detected temperatures, and compares the determined temperature difference with first and second thresholds, respectively. Then, the first and second temperature difference-detecting circuits 81 and 82 output first and second comparison results, respectively.

For example, when the temperature difference is not smaller than the first and second thresholds, the first and second temperature difference-detecting circuits 81 and 82 output respective signals at a high level (hereinafter referred to as the high level signals) as the first and second comparison results, respectively.

On the other hand, when the temperature difference is smaller than the first and second thresholds, the first and second temperature difference-detecting circuits 81 and 82 output respective signals at a low level (hereinafter referred to as the low level signals) as the first and second comparison results. It should be noted that the second threshold is set to be larger than the first threshold.

The first and second comparison results are delivered to the switching circuit 83. The switching circuit 83 is controlled to be switched according to the switching signal output from the CPU 70, and selectively delivers the first or second comparison result to the heating control circuit 71 as a comparison circuit output (selected comparison result).

Figure 6:
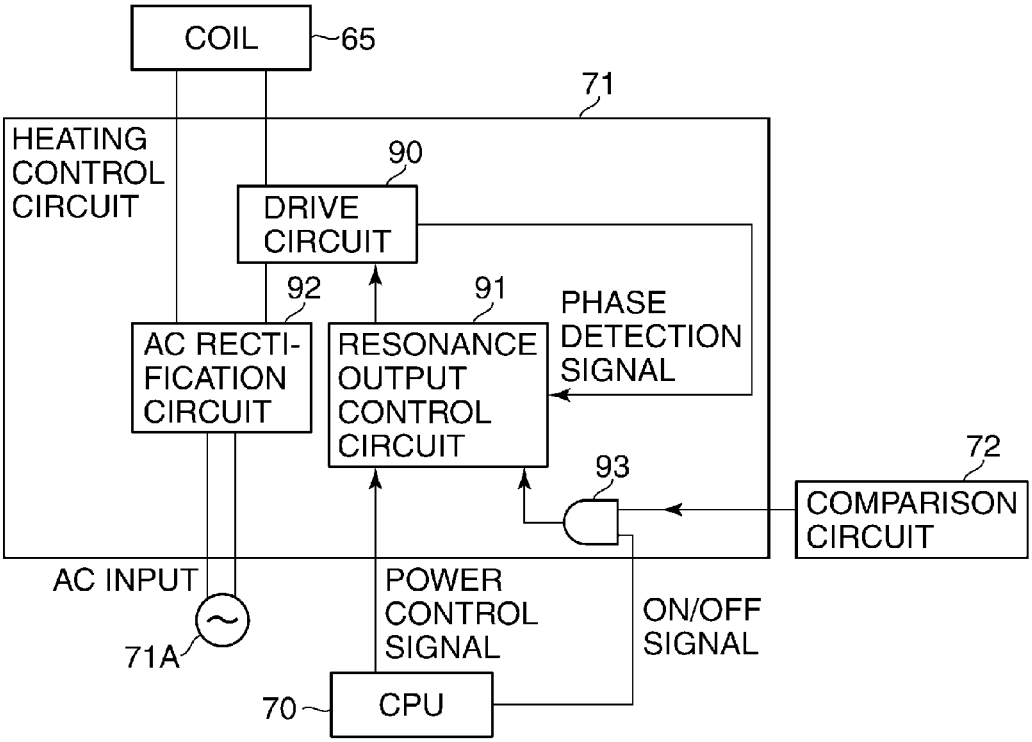
FIG. 6 is a block diagram of a heating control circuit appearing in FIG. 4 and component elements associated therewith.

FIG. 6 is a block diagram of an example of the heating control circuit 71 appearing in FIG. 4. Referring to FIG. 6, the illustrated heating control circuit 71 includes an AND gate 93, a drive circuit 90, a resonance output control circuit 91, and an AC rectification circuit 92.

The CPU 70 delivers an ON/OFF signal to the AND gate 93 of the heating control circuit 71. Further, to the AND gate 93 is delivered the above-mentioned comparison circuit output. The AND gate 93 determines a logical product of the ON/OFF signal and the comparison circuit output to output an enable signal as a logical product signal. Then, this enable signal is delivered to the resonance output control circuit 91. When the enable signal is e.g. a high level signal, the resonance output control circuit 91 is in an enabled state.

On the other hand, the CPU 70 outputs a power control signal to the resonance output control circuit 91, and the resonance output control circuit 91 generates a square-wave PFM (pulse frequency modulation) signal according to the power control signal and a phase detection signal fed back by the drive circuit 90. This PFM signal is supplied to the drive circuit 90.

The AC rectification circuit 92 rectifies AC electric power input from an AC power supply 71A to form DC electric power. The drive circuit 90 converts the DC electric power into high-frequency power according to the PFM signal, and detects a phase of frequency of the high-frequency power to feed back the detected phase to the resonance output control circuit 91 as the phase detection signal. Then, the drive circuit 90 applies the high-frequency power to the coil 65 to heat the fixing roller 32 (FIG. 4) by electromagnetic induction.

Figure 7A:
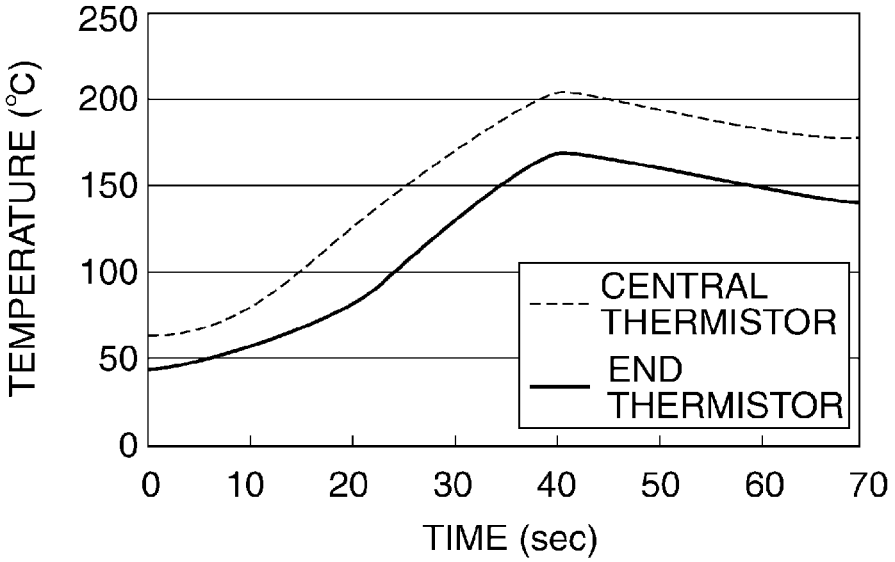
FIG. 7A illustrates changes in the respective temperatures of a central portion and an end portion of a fixing roller at the start of the image forming apparatus shown in FIG. 1 when the fixing roller is in a usual state.
Figure 7B:
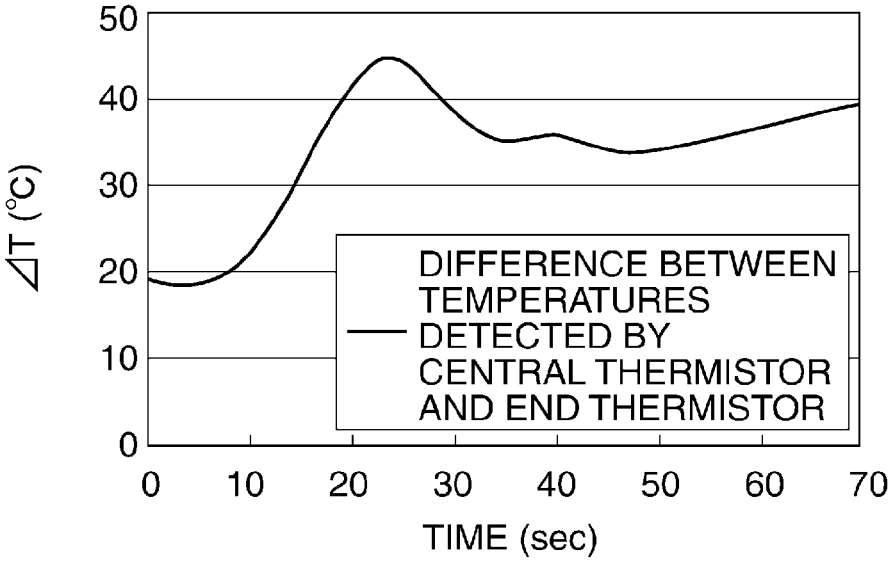
FIG. 7B illustrates changes in a temperature difference ΔT which is a difference between temperatures detected respectively by a central thermistor and an end thermistor, appearing in FIG. 5, at the start of the image forming apparatus shown in FIG. 1 when the fixing roller is in the usual state.

FIGS. 7A and 7B are diagrams useful in explaining an example of changes in temperatures of the fixing roller at the start of the image forming apparatus shown in FIG. 1. FIG. 7A illustrates changes in respective temperatures of a central portion and an end portion of the fixing roller 32 when the fixing roller 32 is in a usual state (normal state), and FIG. 7B illustrates changes in a temperature difference $\Delta T$ which is a difference between the temperatures detected respectively by the central thermistor 62 and the end thermistor 63, appearing in FIG. 5, when the fixing roller 32 is in the usual state. It should be noted that the usual state is intended to mean a state in which no recording sheet is wrapped around the fixing roller 32.

As shown in FIG. 7A, after starting the image forming apparatus (after turning on the power), the fixing roller 32 is heated for about 40 seconds until the first detected temperature (temperature detected by the central thermistor 62) reaches approximately 200° C. (indicated by a dashed line). It should be noted that the relationship between the time and the temperature is not limited to this example.

The end thermistor 63 is located outside the coil 65 as described above, and hence the end thermistor 63 is not readily warmed. Therefore, the second detected temperature (indicated by a solid line) increases more slowly than the first detected temperature (indicated by a dashed line). That is, the first detected temperature is always higher than the second detected temperature, and in the illustrated example in FIG. 7B, 15 seconds after the start of heating the fixing roller 32, the temperature difference ΔT becomes larger than 30° C.

Figure 8A:
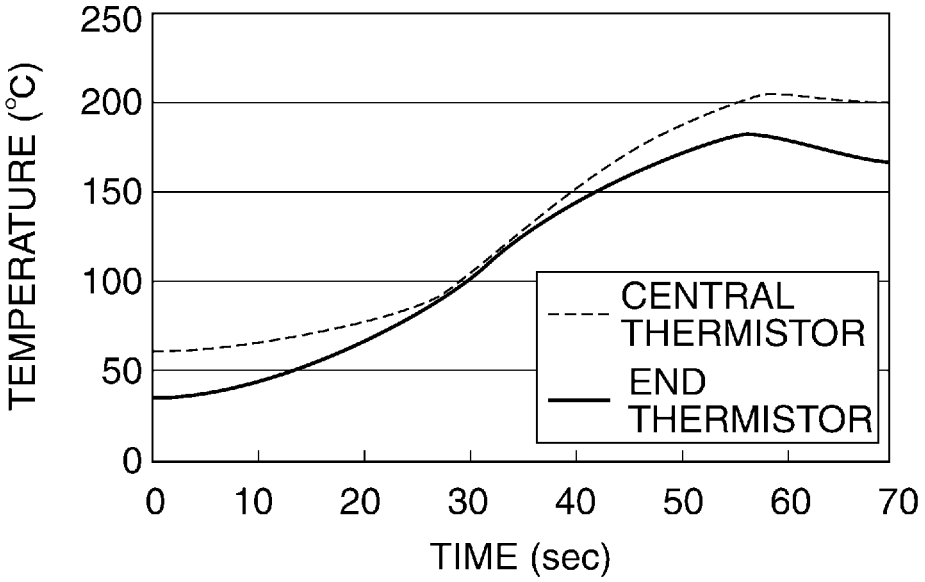
FIG. 8A illustrates changes in the respective temperatures of the central portion and the end portion of the fixing roller when heating is started in a state in which a recording sheet is wrapped around the fixing roller appearing in FIG. 2 at the start of the image forming apparatus shown in FIG. 1.
Figure 8B:
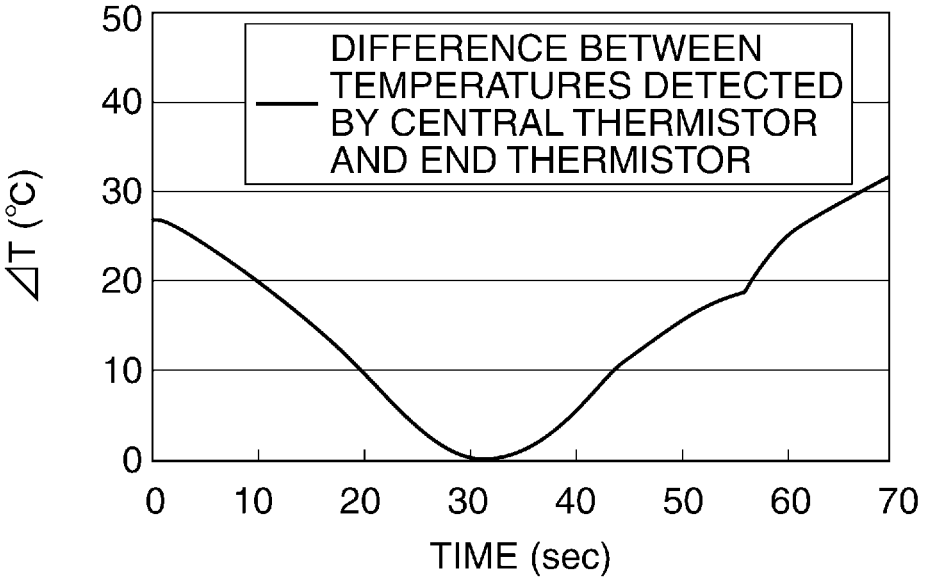
FIG. 8B illustrates changes in the temperature difference ΔT, when heating is started in the state in which the recording sheet is wrapped around the fixing roller appearing in FIG. 2 at the start of the image forming apparatus.

FIGS. 8A and 8B are diagrams useful in explaining another example of changes in the temperatures of the fixing roller at the start of the image forming apparatus shown in FIG. 1. FIG. 8A illustrates changes in the respective temperatures of the central portion and the end portion of the fixing roller 32 when heating is started in a state in which a recording sheet is wrapped around the fixing roller 32 appearing in FIG. 2. Further, FIG. 8B illustrates changes in the temperature difference ΔT when heating is started in the state in which a recording sheet is wrapped around the fixing roller 32 appearing in FIG. 2.

As shown in FIG. 8A, in the state in which a recording sheet is wrapped around the fixing roller 32, the recoding sheet is positioned between the central thermistor 62 and the fixing roller 32, so that the heat is taken by the recording sheet. This causes the central thermistor 62 to sense the temperature as if the temperature of the fixing roller 32 is low. As a result, the first detected temperature is lower than the actual surface temperature of the fixing roller 32.

On the other hand, as mentioned above, the end thermistor 63 is located outside the sheet-passing area where sheets having the maximum sheet size can pass, and hence a wrap jam of a recording sheet around the fixing roller 32 hardly has influence on the end thermistor 63. That is, the increase in the temperature of the end portion of the fixing roller 63 is substantially the same as that in the usual state (normal state).

This is why the ascending curves in the first and second detected temperatures are substantially the same, and the temperature difference ΔT as the difference between the first and second detected temperatures becomes smaller than that in the normal state. As shown in FIG. 8B, the temperature difference ΔT remains smaller than 30° C. until about 70 seconds elapse after the start of heating the fixing roller 32.

As described above, a comparison made between when the fixing roller 32 is in the usual state and when it is in the state having a recording sheet wrapped therearound shows that there is quite a different behavior in the change of the temperature difference ΔT therebetween. Accordingly, it is clearly understood from FIGS. 7B and 8B that when the temperature difference (also referred to as the detected temperature difference) ΔT is smaller than a predetermined threshold, it can be judged that a recording sheet is wrapped around the fixing roller 32.

Incidentally, the changes in the temperature difference ΔT shown in FIGS. 7B and 8B vary with the temperature in the environment where the image forming apparatus is installed. That is, the slope of increase in the first and second detected temperatures varies with the environmental temperature.

For example, assuming that the environmental temperature around the image forming apparatus is low, when the fixing roller 32 is heated, the heat is taken by the circumference. This takes longer time to increase the first detected temperature to approximately 200° C. than about 40 seconds indicated in FIG. 7A. In this case, naturally, it also takes longer time to increase the second detected temperature than that indicated in FIG. 7A.

However, as mentioned above, since the end thermistor 63 is located outward of the coil 65, the first detected temperature is higher than the second detected temperature in the usual state. Further, at the start of the image forming apparatus, both of the first and second detected temperatures are indicated by ascending curves, but neither of which is indicated by a descending curve. Therefore, it is preferable to detect the temperature difference ΔT which is the difference between the first and second detected temperatures with reference to the second detected temperature.

Figure 9:
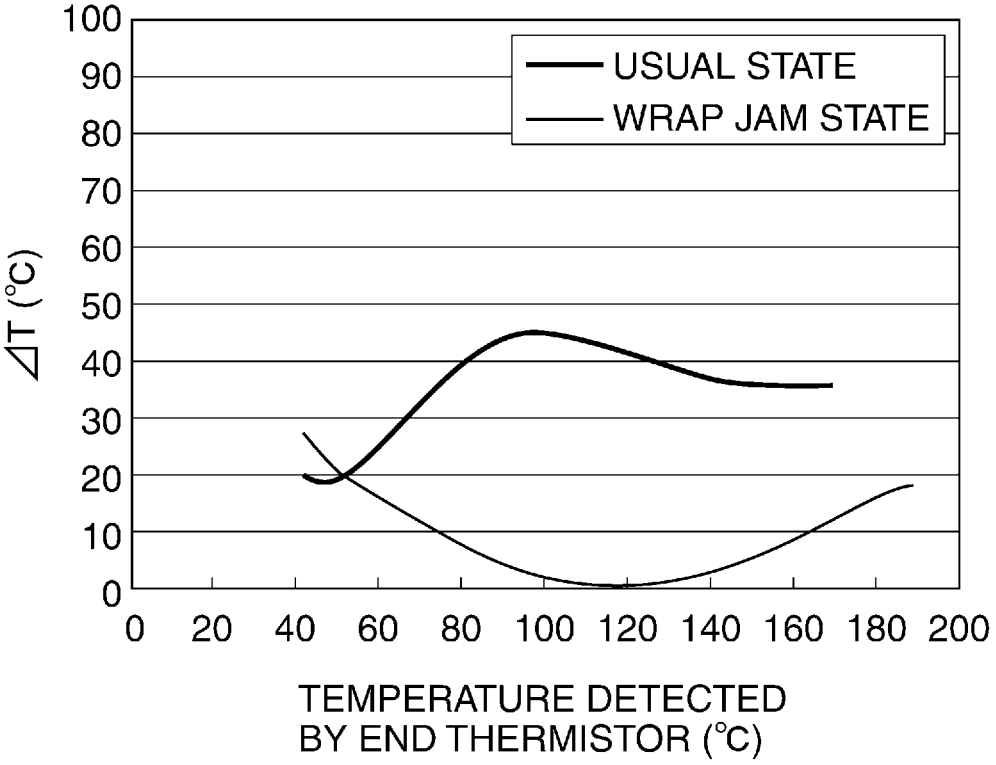
FIG. 9 illustrates a relationship between the temperature detected by the end thermistor appearing in FIG. 4 and a difference between the temperatures detected respectively by the central thermistor and the end thermistor.

FIG. 9 illustrates a relationship between the temperature detected by the end thermistor 63 appearing in FIG. 4 and the temperature difference ΔT between the temperatures detected by the central thermistor 62 and the end thermistor 63.

In FIG. 9, a horizontal axis indicates temperature detected by the end thermistor 63 (second detected temperature), and a vertical axis indicates the difference ΔT between the temperatures detected by the central thermistor 62 and the end thermistor 63.

As shown in FIG. 9, in the usual state (state in which no recording sheet is wrapped around the fixing roller 32: indicated by a thick solid line), when the second detected temperature becomes not lower than 70° C., the detected temperature difference ΔT is not smaller than 30° C. On the other hand, in the state in which a recording sheet is wrapped around the fixing roller 32 (indicated by a thin solid line), it is clear that the detected temperature difference ΔT is always not larger than 30° C.

It should be noted that at the start of the start-up operation in the usual state, since both of the first and second detected temperatures are the same as the environment temperature, the detected temperature difference ΔT is not larger than 30° C. Therefore, after the second detected temperature becomes not lower than a first predetermined reference temperature (e.g. 70° C.), the detected temperature difference ΔT becomes not smaller than 30° C. Therefore, it is necessary not to detect an error before the second detected temperature becomes not lower than the first predetermined reference temperature.

Figure 10:
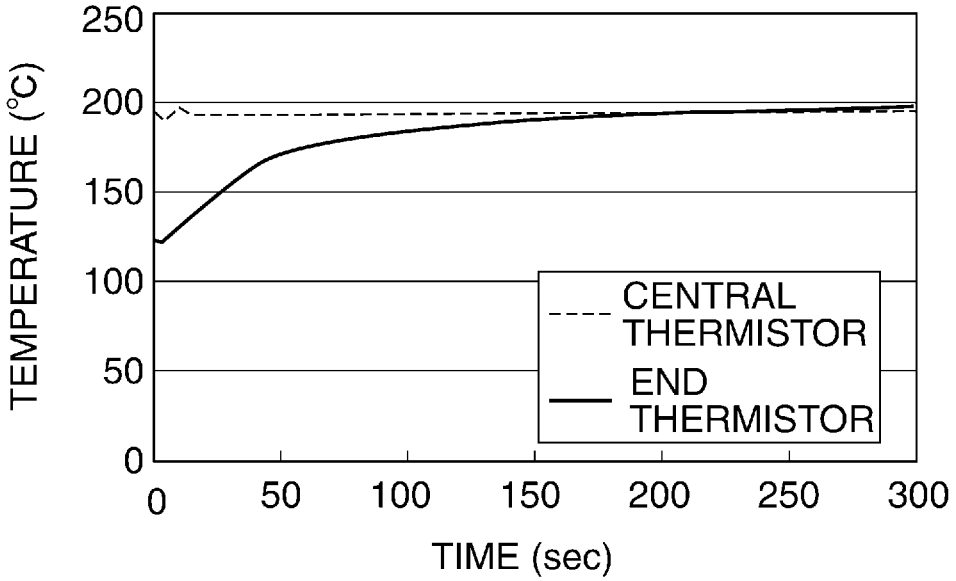
FIG. 10 is a diagram useful in explaining changes in the temperatures detected respectively by the central thermistor and the end thermistor, appearing in FIG. 4, during the printing operation.

FIG. 10 is a diagram useful in explaining changes in temperatures detected by the central thermistor 62 and the end thermistor 63, appearing in FIG. 4, during the printing operation.

In FIG. 10, as mentioned above, the central thermistor 62 is located in the sheet-passing area. In the sheet-passing area, the heat taken by the recording sheet is supplied by the coil 65, whereby the surface temperature of the fixing roller 32 is controlled to be maintained at a constant temperature. Therefore, there is little change in the temperature in the sheet-passing area.

On the other hand, as mentioned above, the end thermistor 63 is located in the non-sheet-passing area. In the non-sheet-passing area, the heat is never taken by a recording sheet. That is, while heat is generated in order to control the temperature of the fixing roller 32 to a constant temperature by the electromagnetic induction heating using the coil 65, the amount of heat release is less than the amount of heat generation. As a result, in the non-sheet-passing area, the temperature steeply changes.

Figure 11:
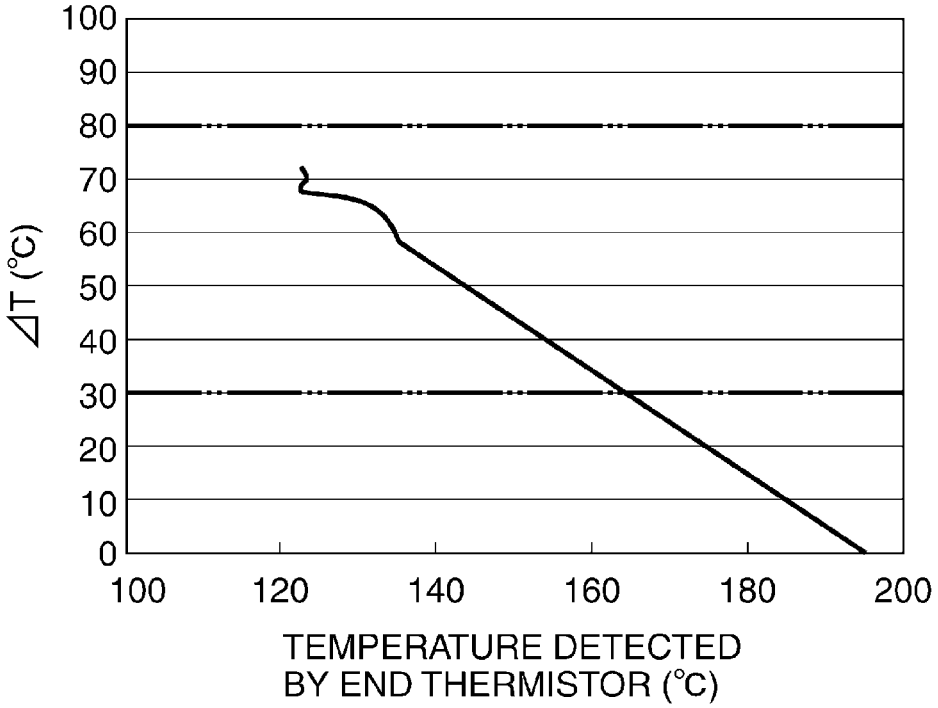
FIG. 11 illustrates a relationship between the temperature detected by the end thermistor appearing in FIG. 4 and the difference between the temperature detected by the central thermistor and that detected by the end thermistor in a state illustrated in FIG. 10.

FIG. 11 illustrates a relationship between the temperature detected by the end thermistor 63 appearing in FIG. 4 and the difference ΔT between the temperatures detected by the central thermistor 62 and the end thermistor 63, in the case where the fixing roller 32 is in the state illustrated in FIG. 10.

In FIG. 11, a horizontal axis indicates the temperature detected by the end thermistor 63 (second detected temperature), and a vertical axis indicates the difference ΔT between the temperatures detected by the central thermistor 62 and the end thermistor 63.

As shown in FIGS. 10 and 11, when the second detected temperature rises, the detected temperature difference ΔT becomes smaller, and eventually becomes not larger than 30° C. In this example, therefore, if the second detected temperature is not lower than a second predetermined reference temperature (e.g. 100° C.), even though the detected temperature difference ΔT becomes not larger than 30° C. (threshold: indicated by a two-dot chain line in FIG. 11), it is necessary not to detect this state as an error.

By the way, if the central thermistor 62 or the end thermistor 63 suffers from disconnection in an intermediate portion thereof, this prevents the central thermistor 62 or the end thermistor 63 from obtaining the first or second detected temperature. Similarly, if the central thermistor 62 or the end thermistor 63 is damaged, the central thermistor 62 or the end thermistor 63 cannot accurately detect the first or second detected temperature. In view of this, there is provided an abnormality-detecting unit, not shown, for detecting occurrence of an abnormality in the central thermistor 62 or the end thermistor 63 when the detected temperature difference ΔT becomes not smaller than a temperature set in advance. This abnormality-detecting unit is implemented by the CPU 70.

For example, when the end thermistor 63 suffers from disconnection or the like, the end thermistor 63 cannot detect the temperature of the fixing roller 32, and hence the output from the end thermistor 63, i.e. the second detected temperature indicates a temperature in the vicinity of 0° C. In the illustrated example, a threshold (error threshold: indicated by a two-dot chain line in FIG. 11) is set such that when the detected temperature difference ΔT>80° C. holds, an error is detected.

With this configuration, assuming that the end thermistor 63 suffers from disconnection or the like, causing the second detected temperature to become a temperature in the vicinity of 0° C., if the first detected temperature becomes about 80° C., an error is detected. Then, if the fixing control is interrupted by this error, since the temperature of the fixing roller 32 increases only up to about 80° C., it is possible to safely stop the fixing device.

As described above, in the present embodiment, a wrap jam of a recording sheet around the fixing roller 32 is detected and at the same time disconnection of the thermistor or the like is detected, without an erroneous detection. To this end, in the illustrated example, as described above, the switching circuit 83 appearing in FIG. 5 switches between the respective outputs from the first and second temperature difference-detecting circuits 81 and 82 according to the second detected temperature during temperature rise of the fixing roller 32 at the start of the image forming apparatus.

Figure 12:
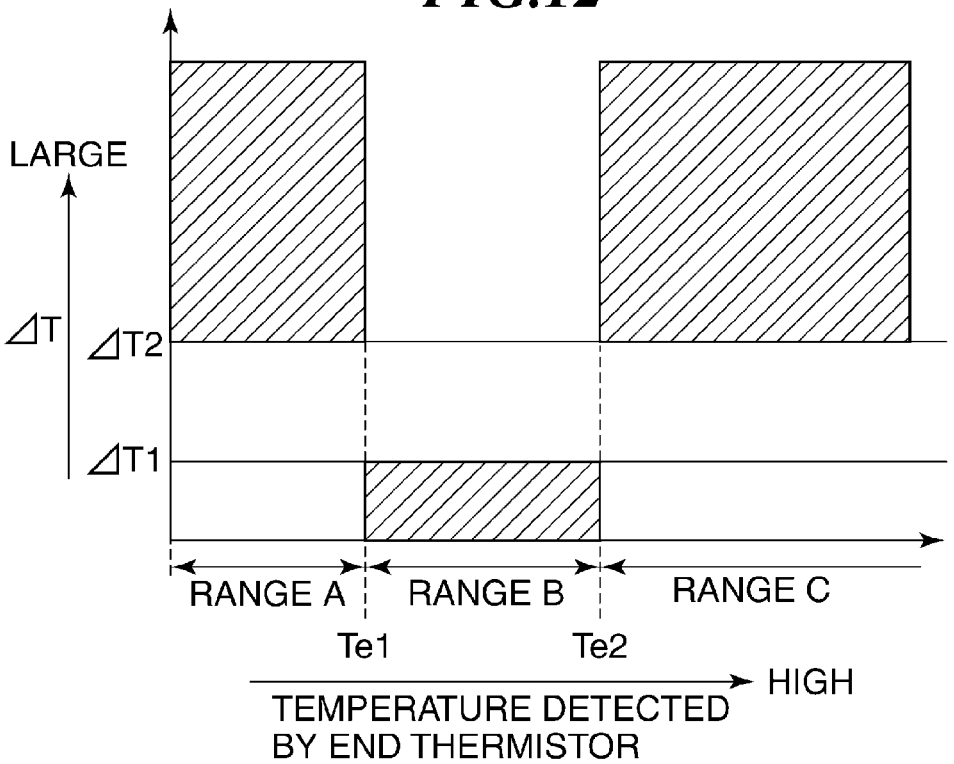
FIG. 12 is a diagram useful in explaining switching between first and second thresholds of the difference between the temperatures detected by the central thermistor and the end thermistor, respectively, according to the temperature detected by the end thermistor appearing in FIG. 4 (second detected temperature).

FIG. 12 is a diagram useful in explaining switching between the first and second thresholds of the difference ΔT between the temperatures detected by the central thermistor 62 and the end thermistor 63, respectively, according to the temperature detected by the end thermistor 63 appearing in FIG. 4 (second detected temperature).

In FIG. 12, a horizontal axis indicates the temperature detected by the end thermistor 63 (second detected temperature), and a vertical axis indicates the difference ΔT between the temperatures detected by the central thermistor 62 and the end thermistor 63.

Referring to FIGS. 5 and 12, a range A (second temperature range) is a range of the temperature detected by the end thermistor 63 (second detected temperature) which is to be detected from the start of heating the fixing roller 32 until it reaches a temperature Te1 (first reference temperature).

In the range A, the CPU 70 causes the switching circuit 83 to switch to connect the second temperature difference-detecting circuit 82 to the heating control circuit 71. That is, in the range A, the CPU 70 enables the output from the second temperature difference-detecting circuit (second temperature difference-comparing unit) 82, but disables the output from the first temperature difference-detecting circuit (first temperature difference-comparing unit) 81. This means that in the range A, an error is detected if the detected temperature difference ΔT becomes larger than the second threshold ΔT2.

A range B (first temperature range) is a range of the temperature detected by the end thermistor 63 (second detected temperature) which is not lower than the temperature Te1 (not lower than the first reference temperature) and at the same time is lower than a temperature Te2 (lower than a second reference temperature). In the range B, the CPU 70 causes the switching circuit 83 to switch to connect the first temperature difference-detecting circuit 81 to the heating control circuit 71. That is, in the range B, the CPU 70 enables the output from the first temperature difference-detecting circuit 81, but disables the output from the second temperature difference-detecting circuit 82. In the range B, an error is detected if the detected temperature difference ΔT becomes smaller than the first threshold ΔT1.

A range C (second temperature range) is a range of the temperature detected by the end thermistor 63 (second detected temperature) which is not lower than the temperature Te2 (not lower than the second reference temperature). In the range C, the CPU 70 controls causes the switching circuit 83 to switch to connect the second temperature difference-detecting circuit 82 to the heating control circuit 71. That is, in the range C, the CPU 70 enables the output from the second temperature difference-detecting circuit 82, but disables the output from the first temperature difference-detecting circuit 81. In the range C, an error is detected if the detected temperature difference ΔT becomes larger than the second threshold ΔT2.

As described above with reference to FIGS. 7 and 8, in the illustrated example, although it is preferable that the temperature to be detected by the end thermistor 63 (second detected temperature) at which the switch-control is performed is set such that the temperature Te1 (first reference temperature)=70° C. and the temperature Te2 (second reference temperature)=about 100° C., these temperatures are only an example, and may be determined as desired according to the configuration of the fixing device.

Figure 13:
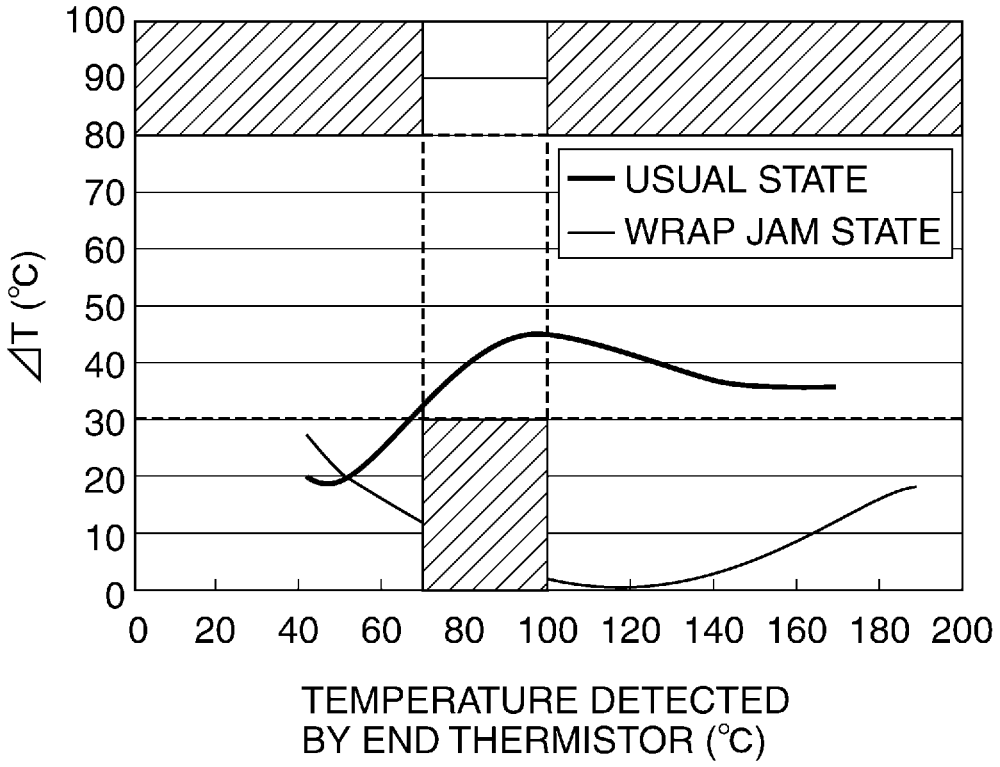
FIG. 13 illustrates detection ranges shown in FIG. 12 in a manner superposed on the relationship between the second detected temperature and the detected temperature difference shown in FIG. 9.

FIG. 13 illustrates the detection ranges shown in FIG. 12 in a manner superposed on the relationship between the second detected temperature and the detected temperature difference ΔT shown in FIG. 9.

In the example illustrated in FIG. 13, it is assumed that the temperature Te1=70° C., the temperature Te2=100° C., the first threshold ΔT1=30° C., and the second threshold ΔT2=80° C. In the usual state (state in which no recording sheet is wrapped around the fixing roller 32: indicated by a thick solid line), a curve is not within error detecting ranges (shaded ranges). Therefore, an error is not detected.

On the other hand, in the state in which a recording sheet is wrapped around the fixing roller (indicated by a thin solid line), when the temperature detected by the end thermistor 63 (second detected temperature) is not lower than 70° C., the detected temperature difference ΔT is within the error detecting range. As a result, an error is detected.

It should be noted that when an error is detected, heating by the fixing roller 32 is stopped, and for example, the fact that an error has occurred is displayed on the display section 14 or the like to notify the user of the error.

Figure 14:
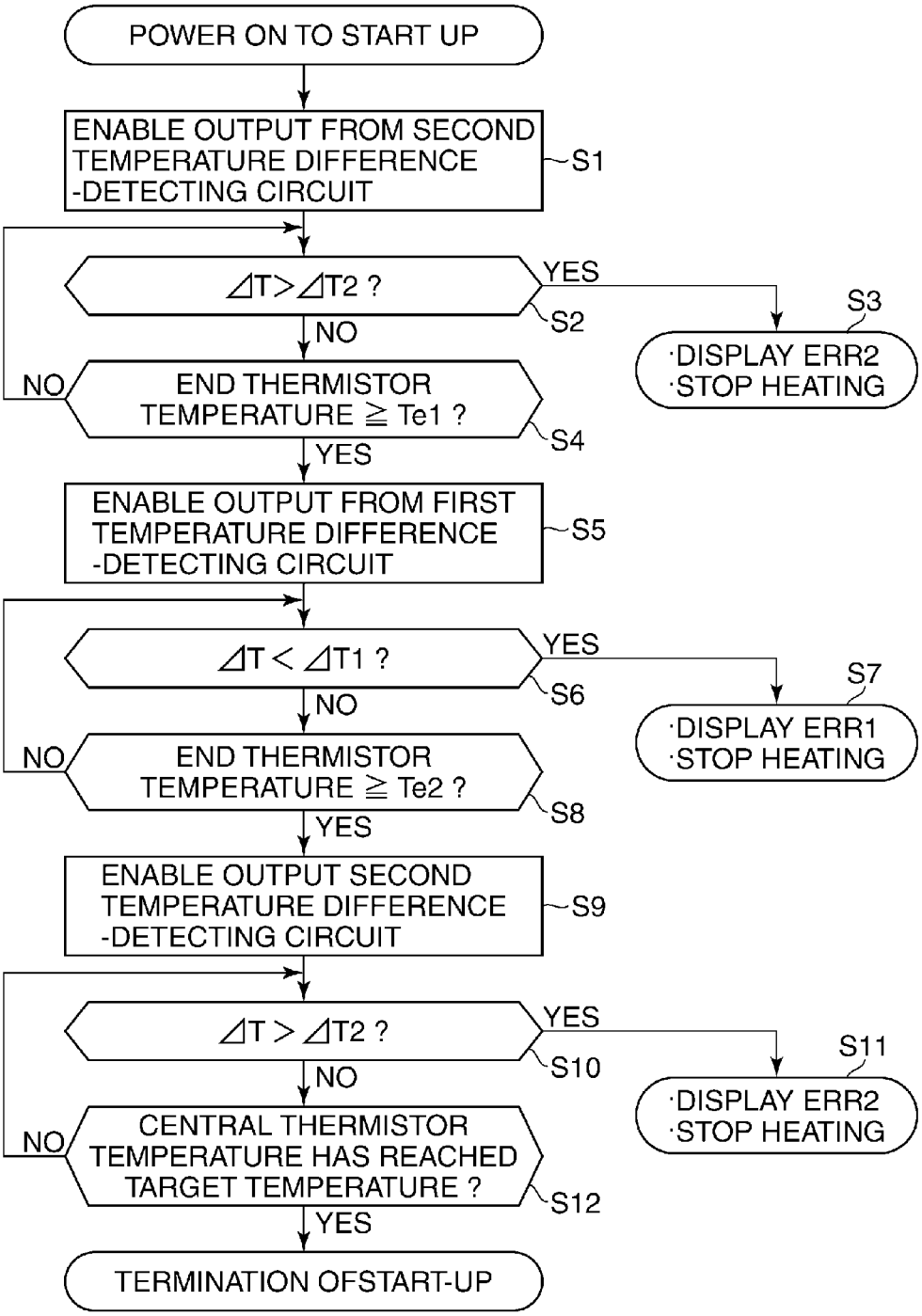
FIG. 14 is a flowchart of a heating control process for the fixing device appearing in FIG. 4.

Next, a description will be given of a heating control process for the fixing device appearing in FIG. 4. FIG. 14 is a flowchart of the heating control process for the fixing device appearing in FIG. 4.

Referring to FIGS. 4 to 6, and 14, now, when the image forming apparatus 1A (FIG. 1) is started by turning on the power, the CPU 70 causes the switching circuit 83 to switch to connect the second temperature difference-detecting circuit 82 to the heating control circuit 71. That is, the CPU 70 enables the output from the second temperature difference-detecting circuit 82 (step S1). As a result, the second comparison result is delivered from the second temperature difference-detecting circuit 82 to the heating control circuit 71 as the comparison circuit output.

The CPU 70 determines whether or not the detected temperature difference ΔT is larger than the second threshold ΔT2 (step S2). If the detected temperature difference ΔT is larger than the second threshold ΔT2 (YES to the step S2), the CPU 70 indicates this fact on the display section 14 (FIG. 1) (display of ERR2), and causes the heating control circuit 71 (i.e. the ON/OFF signal shown in FIG. 6 is OFF) to stop heating of the fixing roller 32 (step S3).

On the other hand, if the detected temperature difference ΔT is not larger than the second threshold ΔT2 (NO to the step S2), the CPU 70 determines whether or not the temperature detected by the end thermistor 63 (second detected temperature) is not lower than the temperature Te1 (not lower than the first reference temperature) (step S4). Then, if the second detected temperature is lower than the temperature Te1 (lower than the first reference temperature) (NO to the step S4), the CPU 70 returns to the step S2 to continue the process.

If the second detected temperature is not lower than the temperature Te1 (YES to the step S4), the CPU 70 causes the switching circuit 83 to switch to connect the first temperature difference-detecting circuit 81 to the heating control circuit 71. That is, the CPU 70 enables the output from the first temperature difference-detecting circuit 81 (step S5). As a result, the first comparison result is delivered from the first temperature difference-detecting circuit 81 to the heating control circuit 71 as the comparison circuit output.

Then, the CPU 70 determines whether or not the detected temperature difference ΔT is smaller than the first threshold ΔT1 (step S6). If the detected temperature difference ΔT is smaller than the first threshold ΔT1 (YES to the step S6), the CPU 70 indicates this fact on the display section 14 (FIG. 1) (display of ERR1), and causes the heating control circuit 71 to stop heating of the fixing roller 32 (step S7).

If the detected temperature difference ΔT is not smaller than the first threshold ΔT1 (NO to the step S6), the CPU 70 determines whether or not the temperature detected by the end thermistor 63 (second detected temperature) is not lower than the temperature Te2 (not lower than the second reference temperature) (step S8). If the second detected temperature is lower than the temperature Te2 (lower than the second reference temperature) (NO to the step S8), the CPU 70 returns to the step S6 to continue the process.

On the other hand, if the second detected temperature is not lower than the temperature Te2 (YES to the step S8), the CPU 70 causes the switching circuit 83 to switch to connect the second temperature difference-detecting circuit 82 to the heating control circuit 71. That is, the CPU 70 enables the output from the second temperature difference-detecting circuit 82 (step S9). Then, the CPU 70 determines whether or not the detected temperature difference ΔT is larger than the second threshold ΔT2 again (step S10).

If the detected temperature difference ΔT is larger than the second threshold ΔT2 (YES to the step S10), the CPU 70 displays this fact on the display section 14 (FIG. 1) (display of ERR2), and causes the heating control circuit 71 to stop heating of the fixing roller 32 (step S11).

If the detected temperature difference ΔT is not larger than the second threshold ΔT2 (NO to the step S10), the CPU 70 determines whether or not the temperature detected by the central thermistor 62 (first detected temperature) has reached a target temperature (step S12). If the first detected temperature is lower than the target temperature (NO to the step S12), the CPU 70 returns to the step S10 to continue the process.

On the other hand, if the first detected temperature has reached the target temperature (YES to the step S12), the CPU 70 terminates the start-up operation. Thereafter, in a state in which the second temperature difference-detecting circuit 82 is validated, the printing operation or the like is performed.

Thus, in the above-described example, the switching between the first and second temperature difference-detecting circuits 81 and 82 is controlled according to the temperature detected by the central thermistor 62 (first detected temperature) and the temperature detected by the end thermistor 63 (second detected temperature) to detect whether or not a recording sheet is wrapped around the fixing roller 32.

It should be noted that although the heating control process for the fixing device described with reference to FIG. 14 is performed when the power switch is turned on, this control process can be applied not only to the case where the power switch is turned on but also similarly to any cases insofar as the heating of the fixing device is started by applying current, including a case where the image forming apparatus returns from a power-saving mode. That is, the heating control process illustrated in FIG. 14 is executed when the image forming apparatus returns to an active state from a standby state to which the image forming apparatus has shifted after the start-up.

As described above, in the present embodiment, the first threshold ΔT1 and the second threshold ΔT2 larger than the first threshold ΔT1 are set with respect to the detected temperature difference ΔT. Further, with reference to the temperature detected by the end thermistor 63 (second detected temperature), the temperature Te1 (first reference temperature) and the temperature Te2 (second reference temperature) higher than the temperature Te1 are set with respect to the second detected temperature.

Then, when the power is turned on, the CPU 70 performs switching control of the first and second temperature difference-detecting circuits 81 and 82 according to the first and second thresholds and the first and second reference temperatures, and determines whether or not a wrap jam of a recording sheet around the fixing roller 32 has occurred.

As a result, it is possible to easily detect a wrap jam of a recording sheet without increasing costs. That is, it is possible to reduce the time required to detect fixing abnormality at the start of the image forming apparatus, which makes it possible to reduce the time to elapse before the heating of the fixing device is stopped.

It should be noted that as is clear from the above description, the first and second temperature difference-detecting circuits 81 and 82 function as comparing units. Further, the CPU 70 and the switching circuit 83 function as a selection unit, and the CPU 70 and the heating control circuit 71 function as a heating control unit. Further, the CPU 70 functions as a first stop unit and a second stop unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-106405, filed May 6, 2010, which is hereby incorporated by reference herein in its entirety.

What is claimed is:

1. A fixing device comprising:

a fixing unit configured to be subject to heating control to thereby fix a toner image on a recording medium;

a first temperature-detecting unit configured to detect a temperature of the fixing unit in an area where the recording medium passes to obtain a first detected temperature;

a second temperature-detecting unit configured to detect a temperature of the fixing unit in an area where the recording medium does not pass to obtain a second detected temperature;

a temperature difference-comparing unit configured to compare a temperature difference between the first and second detected temperatures with at least one of a first threshold or a second threshold, which is larger than the first threshold; and a control unit configured to:

control heating of the fixing unit so that the temperature detected by the first temperature-detecting unit reaches a target temperature;

control, until the temperature detected by the second temperature-detecting unit is at or surpasses a first reference temperature, which is lower than the target temperature, the temperature difference-comparing unit to compare the temperature difference with the second threshold, and stop heating of the fixing unit and generate a signal indicating a second abnormality based on the temperature difference being larger than the second threshold; and control, upon the temperature detected by the second temperature-detecting unit being at or surpassing the first reference temperature, the temperature difference-comparing unit to compare the temperature difference with the first threshold, and stop heating of the fixing unit and generate a signal indicating a first abnormality based on the temperature difference being smaller than the first threshold.

2. The fixing device according to claim 1, wherein the control unit controls, upon the temperature detected by the second temperature-detecting unit being at or surpassing a second reference temperature, which is higher than the first reference temperature, the temperature difference-comparing unit to compare the temperature difference with the second threshold, and stop heating of the fixing unit and notify the second abnormality when the temperature difference is larger than the second threshold.

3. The fixing device according to claim 2, wherein the control unit stops comparing the temperature difference with the second threshold upon the temperature detected by the first temperature-detecting unit is at or surpasses the target temperature, after the temperature detected by the second temperature-detecting unit become higher than the second reference temperature.

4. The fixing device according to claim 1, wherein the temperature difference-comparing unit comprises:

a first comparison circuit configured to compare, with the first threshold, the difference between the temperature detected by the first temperature-detecting unit and the temperature detected by the second temperature-detecting unit; and a second comparison circuit configured to compare, with the second threshold, the difference between the temperature detected by the first temperature-detecting unit and the temperature detected by the second temperature-detecting unit.

5. The fixing device according to claim 1, wherein the first abnormality means an abnormality where the recording medium is wrapped around the fixing unit, and the second abnormality means an abnormality of the first temperature-detecting unit or the second temperature-detecting unit.

6. An image forming apparatus comprising:

a transfer unit configured to transfer a toner image onto a recording medium according to image data;

a fixing unit configured to be subject to heating control to thereby fix the toner image transferred by the transfer unit on the recording sheet;

a first temperature-detecting unit configured to detect a temperature of the fixing unit in an area where the recording medium passes to obtain a first detected temperature;

a second temperature-detecting unit configured to detect a temperature of the fixing unit in an area where the recording medium does not pass to obtain a second detected temperature;

a temperature difference-comparing unit configured to compare a temperature difference between the first and second detected temperatures with at least one of a first threshold or a second threshold, which is larger than the first threshold; and a control unit configured to:

control heating of the fixing unit so that the temperature detected by said first temperature-detecting unit reaches a target temperature;

control, until the temperature detected by the second temperature-detecting unit is at or surpasses a first reference temperature, which is lower than the target temperature, the temperature difference-comparing unit to compare the temperature difference with the second threshold, and stop heating of the fixing unit and notify a second abnormality based on the temperature difference being larger than the second threshold; and control, upon the temperature detected by the second temperature-detecting unit being at or surpassing the first reference temperature, the temperature difference-comparing unit to compare the temperature difference with the first threshold, and stop heating of the fixing unit and notify a first abnormality based on the temperature difference being smaller than the first threshold.

7. The image forming apparatus according to claim 6, wherein the control unit controls, upon the temperature detected by the second temperature-detecting unit being at or surpassing a second temperature, which is higher than the first reference temperature, the temperature difference-comparing unit to compare the temperature difference with the second threshold, and stop heating of the fixing unit and notify the second abnormality when the temperature difference is larger than the second threshold.

8. The image forming apparatus according to claim 7, wherein the control unit stops comparing the temperature difference with the second threshold upon the temperature detected by the first temperature-detecting unit being at or surpassing the target temperature, after the temperature detected by the second temperature-detecting unit become higher than the second temperature.

9. The image forming apparatus according to claim 6, wherein the temperature difference-comparing unit comprises:

a first comparison circuit configured to compare, with the first threshold, the difference between the temperature detected by the first temperature-detecting unit and the temperature detected by the second temperature-detecting unit; and a second comparison circuit configured to compare, with the second threshold, the difference between the temperature detected by the first temperature-detecting unit and the temperature detected by the second temperature-detecting unit.

10. The image forming apparatus according to claim 6, wherein the first abnormality means an abnormality where the recording medium is wrapped around the fixing unit, and the second abnormality means an abnormality of the first temperature-detecting unit or the second temperature-detecting unit.

11. A fixing device comprising:

a fixing unit configured to be subject to heating control to thereby fix a toner image on a recording medium;

a first temperature-detecting unit configured to detect a temperature of the fixing unit in an area where the recording medium passes to obtain a first detected temperature;

a second temperature-detecting unit configured to detect a temperature of the fixing unit in an area where the recording medium does not pass to obtain a second detected temperature; and a control unit configured to:

control heating of the fixing unit so that the temperature detected by the first temperature-detecting unit reaches a target temperature; and stop heating of the fixing unit and generate a signal indicating an abnormality, even in a case where the temperature detected by the first temperature-detecting unit does not reach the target temperature, based on the difference between the temperature detected by the first temperature-detecting unit and the temperature detected by the second temperature-detecting unit being smaller than a predetermined threshold, upon the temperature detected by the second temperature-detecting unit being at or surpassing a predetermined temperature, which is lower than the target temperature.

12. The fixing device according to claim 11, wherein the abnormality means an abnormality where the recording medium is wrapped around the fixing unit.

13. An image forming apparatus comprising:

a transfer unit configured to transfer a toner image onto a recording medium according to image data; a fixing unit configured to be subject to heating control to thereby fix the toner image transferred by the transfer unit on the recording sheet;

a first temperature-detecting unit configured to detect a temperature of the fixing unit in an area where the recording medium passes to obtain a first detected temperature;

a second temperature-detecting unit configured to detect a temperature of the fixing unit in an area where the recording medium does not pass to obtain a second detected temperature;

a control unit configured to:

control heating of the fixing unit so that the temperature detected by the first temperature-detecting unit reaches a target temperature; and stop heating of the fixing unit and notify an abnormality, even in a case where the temperature detected by the first temperature-detecting unit does not reach the target temperature, based on the difference between the temperature detected by the first temperature-detecting unit and the temperature detected by the second temperature-detecting unit being smaller than a predetermined threshold, upon the temperature detected by the second temperature-detecting unit being at or surpassing a predetermined temperature, which is lower than the target temperature.

14. The image forming apparatus according to 13, wherein the abnormality means an abnormality where the recording medium is wrapped around the fixing unit.

* * * * *